United States Patent [19]

Nakahara et al.

[11] Patent Number: 4,535,944

[45] Date of Patent: Aug. 20, 1985

[54] SPINNING MACHINE WITH A DOFFING APPARATUS

[75] Inventors: Teiji Nakahara; Shoji Sakai; Koshi Noda; Michiaki Fujiwara; Nobunori Kubota, all of Kyoto, Japan

[73] Assignee: Murata Kikai Kabushiki Kaisha, Japan

[21] Appl. No.: 514,097

[22] Filed: Jul. 15, 1983

[30] Foreign Application Priority Data

Jul. 19, 1982 [JP] Japan ..... 57-126546

[51] Int. Cl.[3] ..... B65H 54/20; B65H 54/26; B65H 67/04

[52] U.S. Cl. ..... 242/35.5 A; 57/261; 57/263; 57/268; 57/328

[58] Field of Search ..... 242/35.5 A, 35.5 R, 242/35.6 R, 18 DD; 57/261, 263, 328, 268, 270, 271

[56] References Cited

U.S. PATENT DOCUMENTS

| | | | |
|---|---|---|---|
| 4,060,963 | 12/1977 | Stahlecker et al. | 57/263 X |
| 4,125,990 | 11/1978 | Stahlecker et al. | 242/35.5 A X |
| 4,138,839 | 2/1979 | Stahlecker et al. | 57/263 X |
| 4,178,748 | 12/1979 | Stahlecker et al. | 252/35.5 A X |
| 4,419,861 | 12/1983 | Fujiwara et al. | 57/261 |

*Primary Examiner*—Stanley N. Gilreath

*Attorney, Agent, or Firm*—Spensley Horn Jubas & Lubitz

[57] ABSTRACT

A spinning machine wherein a yarn knotting truck having a knotter provided thereon travels in a truck travelling spacing provided along a number of spinning units further includes an apparatus for automatically doffing winding packages which have yarns fully wound thereon. A doffing truck which has provided thereon a doffing apparatus travels in the truck travelling spacing.

9 Claims, 11 Drawing Figures

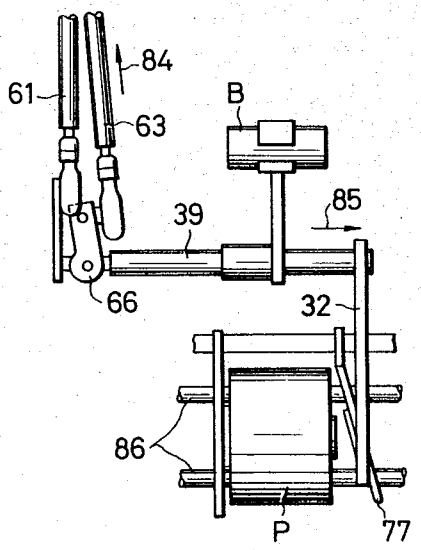
FIG. 4-c
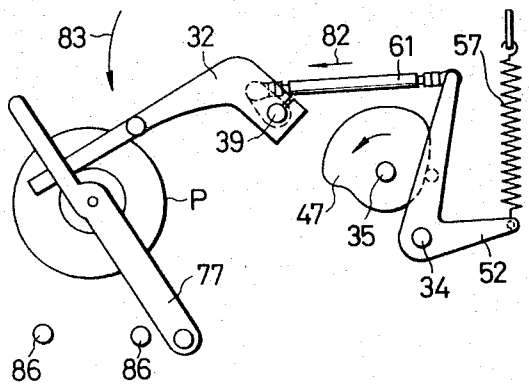
FIG. 4-b
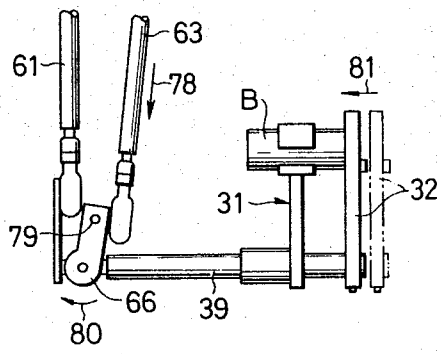
FIG. 4-a

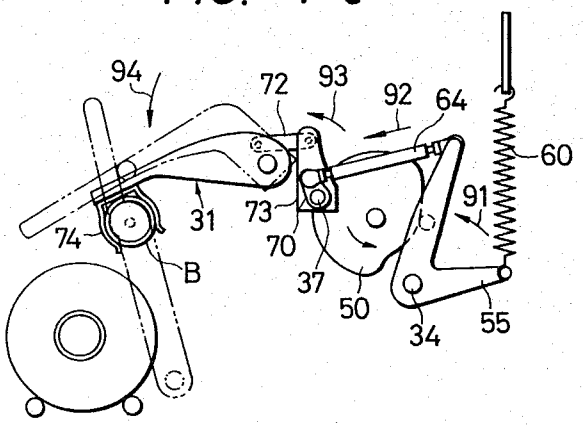
FIG. 4-e
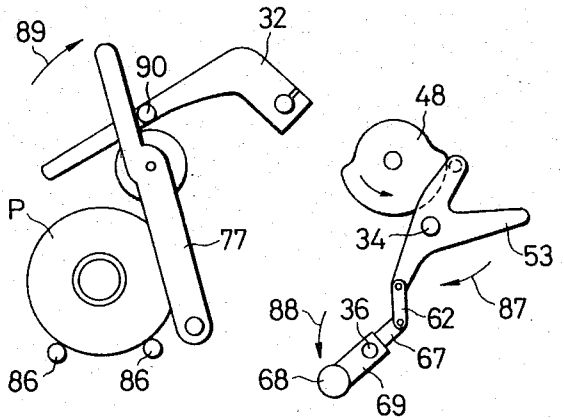
FIG. 4-d

SPINNING MACHINE WITH A DOFFING APPARATUS

BACKGROUND OF THE INVENTION

This invention relates to a spinning machine, and more particularly to a spinning machine of the type which has an apparatus for effecting doffing of packages which have a yarn fully wound thereon.

Spinning machines known as a pneumatic type are conventionally used in which slivers are successively fed to a drafting apparatus including a back roller, a middle roller, a front roller and such other typical elements as may be appropriate, in order to draft them whereafter they are fed to an air jetting nozzle for generating a whirling air flow in order to obtain spun yarns by an action of such a whirling air flow. In such spinning machines, a number of spinning units are disposed in parallel relationship, and a yarn knotting truck having a knotter provided thereon travels along such spinning units in a direction of the length of the spinning machine and stops at a required position in order to effect automatic yarn knotting at a required spinning unit. In particular, a yarn knotting truck first stops, as described in U.S. Pat. No. 4,419,861, in front of a spinning unit at which a yarn has broken, and then an upper yarn of the spinning unit and a lower yarn on a winding package are drawn out and introduced into a knotter provided on the yarn knotting truck in order to effect knotting of the yarns whereafter the yarn knotting truck begins to travel toward another spinning unit at which a yarn breakage has occurred.

SUMMARY OF THE INVENTION

The present invention thus resides in a spinning machine with a yarn knotting truck as described above which includes an apparatus for automatically doffing winding packages which have yarns fully wound thereon, and it is an object of the invention to provide a spinning machine with a doffing apparatus which eliminates a possible additional spacing which may be required for installation of such a doffing apparatus. According to the present invention, already existing equipments can be utilized effectively to realize a functional spinning machine with a doffing apparatus.

BRIEF DESCRIPTION OF THE DRAWINGS

FIGS. 4-*a* to 4-*e* are diagrammatic representations for illustration of a doffing operation;

DETAILED DESCRIPTION OF THE INVENTION

In the followings, a preferred embodiment of the present invention will be described with reference to accompanying drawings.

Figure 1:
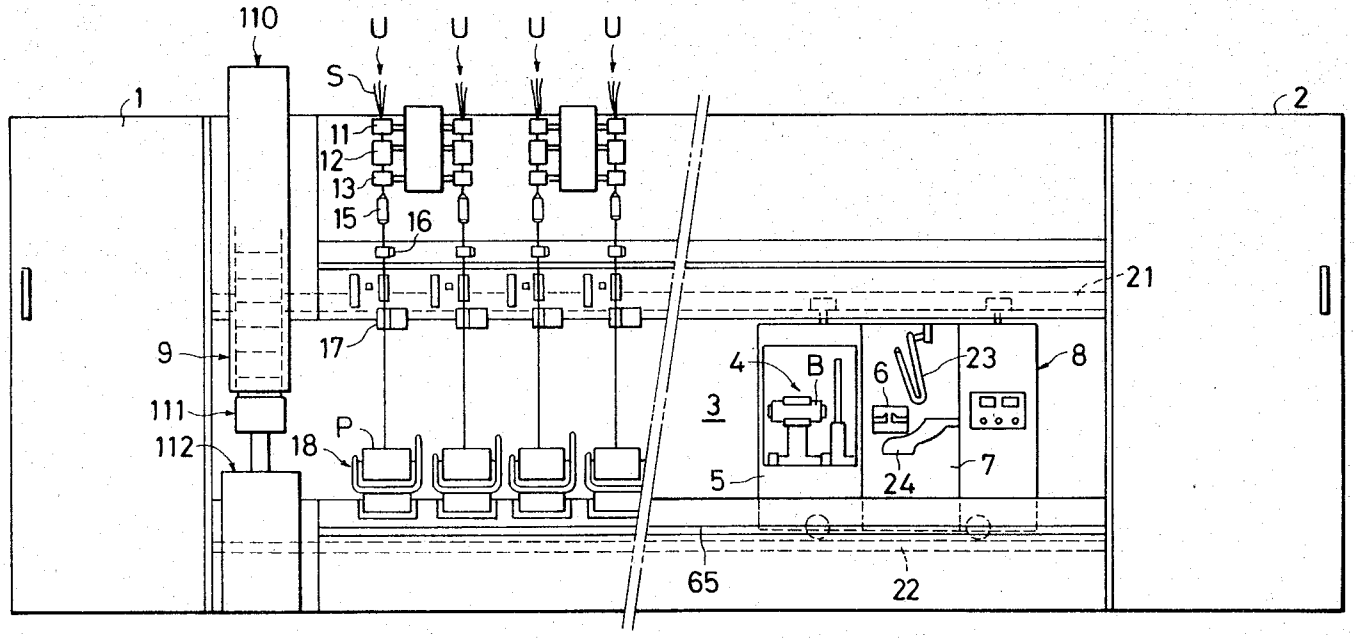
FIG. 1 is a front elevational view of a spinning machine according to the present invention.

Referring first to FIG. 1 which shows a front elevational view of a pneumatic spinning machine according to the present invention, the spinning machine includes a motor box 1, a blower box 2, and a number of spinning units U disposed in a row between the motor box 1 and the blower box 2. A truck travelling space 3 is provided and extends in a direction of the length of a machine bed of the spinning machine along the row of the spinning units U, and a travelling truck 8 travels within the spacing 3. The travelling truck 8 is formed as a combined single truck including a doffing truck 5 having a doffing apparatus 4 provided thereon and a yarn knotting truck 7 having a knotter 6 provided thereon. The travelling truck 8 is generally positioned and relocated in a manner described in detail in U.S. Pat. No. 4,419,861. A bobbin supply device 9 for supplying bobbins to the doffing apparatus 4 is disposed between the motor box 1 and the row of the spinning units U.

Figure 2:
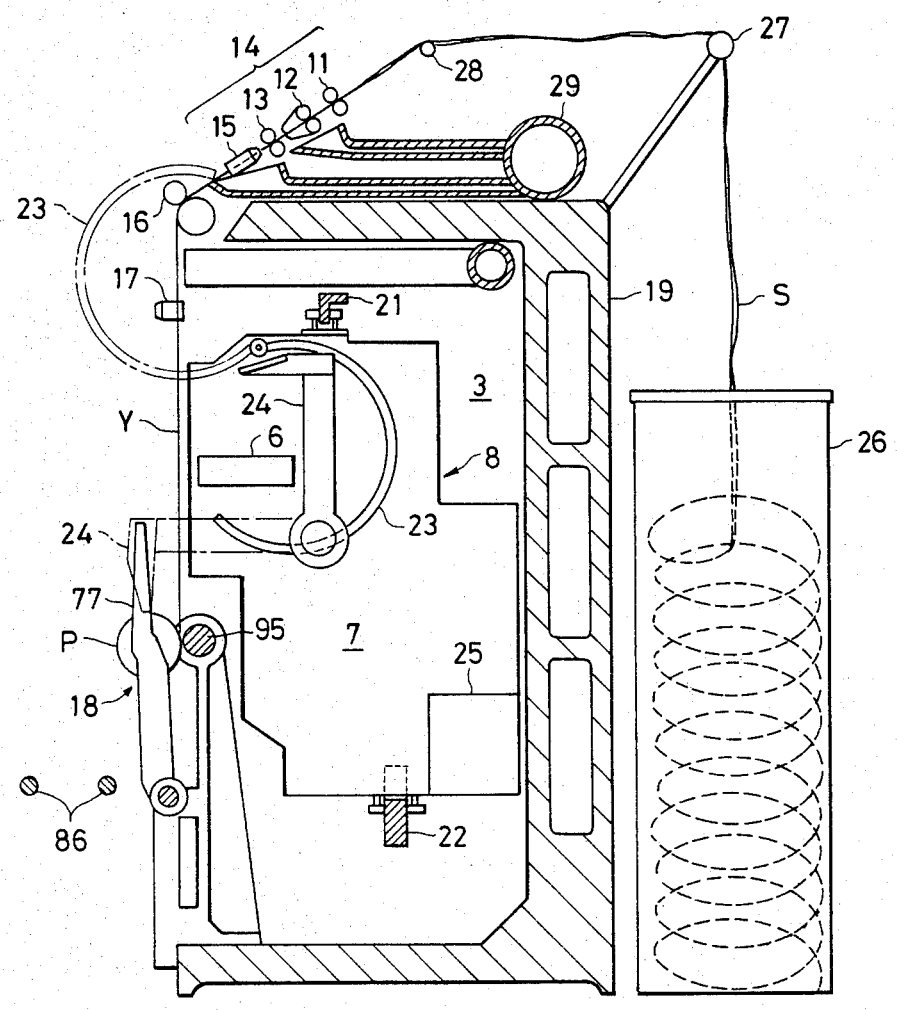
FIG. 2 is a vertical sectional schematic side elevational view across the spinning machine together with a yarn knotting truck.

Referring now to FIG. 2 which shows a vertical sectional side elevational view of the spinning machine together with the yarn knotting truck 7, a spinning unit U includes a draft apparatus 14 which in turn includes back rollers 11, middle rollers 12 and front rollers 13. The spinning unit U further includes an air jetting nozzle 15, a nip roller 16 for drawing out a spun yarn Y produced at the nozzle 15, a slub catcher 17 for detecting a fattened portion of the spun yarn Y, and a winding section 18 for winding the yarn Y on a package P while traversing.

The spinning unit U is located on a frame member 19 having upper and lower horizontal portions and an interconnecting vertical portion which generally define thereamong the aforementioned truck travelling space 3 within which the yarn knotting truck 7 and hence the travelling truck 8 travel along a pair of rails 21 and 22 in a direction leftwards or rightwards as viewed in FIG. 1.

The yarn knotting truck 7 has a suction pipe 23 for sucking an upper yarn from the spinning unit to introduce the upper yarn to the knotter 6, and a suction mouth 24 for sucking a lower yarn from the package P to introduce the lower yarn to the knotter 6. The suction pipe 23 and the suction mouth 24 are individually mounted for pivotal motion to respective positions each as shown by a dot and dash line in FIG. 2. The yarn knotting truck 7 further carries thereon a blower 25 for producing a suction air flow.

In FIG. 2, slivers S which are to be supplied to the drafting apparatus 14 are drawn out from a sliver can 26 located in the rear of the machine bed and fed to the back roller 11, passing by guide rollers 27 and 28. A discharging pipe 29 extends through all of the spinning units U and sucks yarn dusts and the like produced at the drafting apparatus 14 and the air jetting nozzle 15 in order to discharge them externally.

Figure 3:
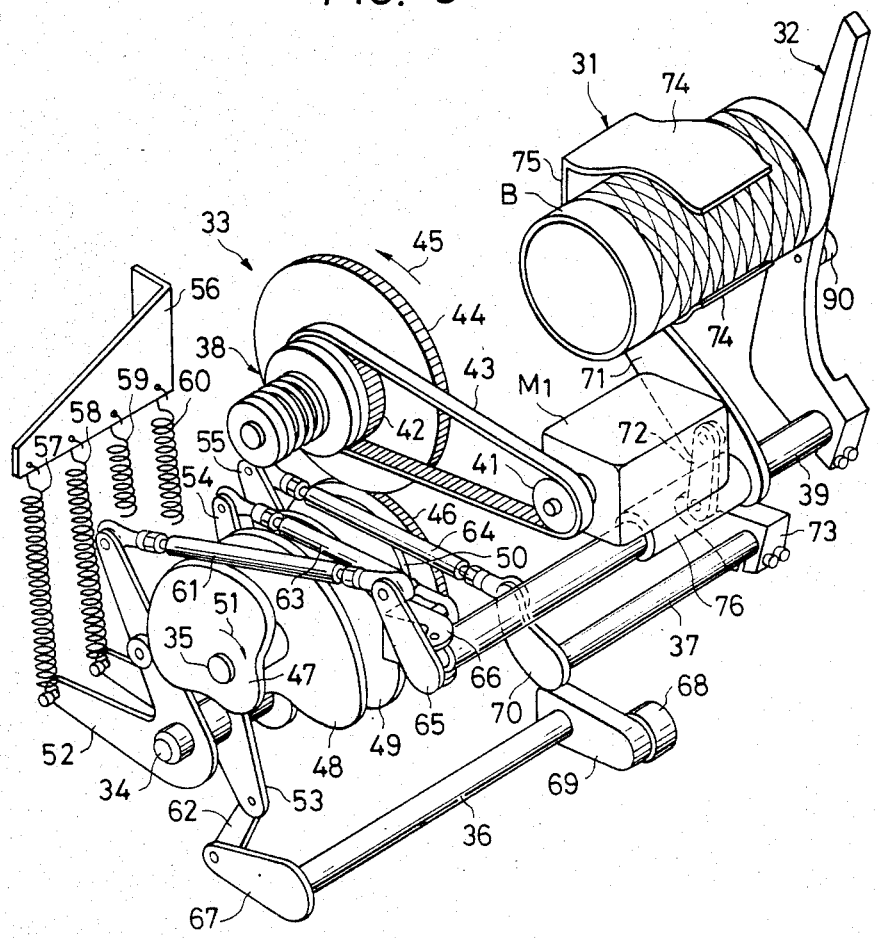
FIG. 3 is a perspective view of a doffing apparatus.

Referring now to FIG. 3 which shows the structure of the doffing apparatus 4 provided on the doffing truck 5, the doffing apparatus 4 includes a bobbin supporting arm 31 for holding a bobbin (paper tube) B thereon and for feeding it to the winding section 18, a cradle opening lever 32 for assisting supply of a bobbin B to the winding section 18, and a driving mechanism 33 for driving the bobbin supporting arm 31 and the cradle opening lever 32. The driving mechanism 33 includes a main shaft 34 supported for rotation on the doffing truck 5, a cam shaft 35, a cradle operating shaft 36, an arm operating shaft 37 and a ball clutch 38, and a lever operating shaft 39 supported for rotational and sliding motion. These elements are driven by a motor M1. A gear 41 of the motor M1 and a small diameter gear 42 provided for the ball clutch 38 are interconnected by means of a toothed belt 43 so that, if the clutch 38 is brought into engagement, then a large diameter gear 44 is rotated in a direction of an arrow mark 45. A further gear 46 and four cam plates 47, 48, 49 and 50 are secured to the cam shaft 35, and the gear 46 is in meshed engagement with the large diameter gear 44 so that it is rotated in a direction of an arrow mark 51. Meanwhile, rocking levers 52, 53, 54 and 55 are mounted for pivotal motion on the main shaft 34 and individually have cam followers thereon which are provided for engagement with the cam plates 47, 48, 49 and 50, respectively. A spring 57, 58, 59 or 60 extends between an end of each of the rocking levers and a plate 56 provided on the doffing truck 5 while rods 61, 62 63 and 64 are connected to the other ends of the rocking levers 52, 53, 54 and 55. The first rod 61 is connected to a finger plate 65 secured to an end of the lever operating shaft 39, and the third rod 63 is connected to a bracket 66 which is pivotally mounted at the same end of the lever operating shaft 39. The second rod 62 is connected to a finger plate 67 secured to one end of the cradle operating shaft 36 which has an operating member 69 secured to the other end thereof. The operating member 69 has a roller 68 thereon. The fourth rod 64 is connected to a finger plate 70 secured to an end of the arm operating shaft 37 which has an operating member 73 secured to the other end thereof. The operating member 73 is connected to an arm portion 71 of the bobbin supporting arm 31 by means of a connecting member 72. The bobbin supporting arm 31 includes, in addition to the arm portion 71, a holding portion 75 having upper and lower spring plates 74 for resiliently holding a bobbin B therebetween, and a cylinder portion 76 mounted for pivotal and sliding motion on the lever operating shaft 39. The aforementioned cradle opening lever 32 is secured to the other end of the lever operating shaft 39.

Operations of the doffing apparatus 4 described above will be described in the followings with reference to FIGS. 3 and 4-*a* through 4-*e*.

After a winding package P has become full, a cradle arm 77 which supports the package P at opposite ends thereof takes a forwardly inclined position, which condition is sensed as described later. On sensing such a condition, the travelling truck 8 begins to travel and then stops, in the manner described in U.S. Pat. No. 4,419,861, when the doffing apparatus 4 is positioned behind the package P. At this instant, the doffing apparatus is in a position as seen in FIG. 3, and simultaneously with stopping of the travelling truck 8, the motor M1 is energized. Then, the ball clutch 38 is brought into engagement so that the cam plates 47, 48, 49 and 50 begin to rotate in a direction of the arrow mark 51 at once. At first, the third cam plate 49 acts on a cam follower not shown to pivot the third rocking lever 54 a little in a rightward direction as viewed in FIG. 3 thereby to move the third rod 63 in a direction of an arrow mark 78 of FIG. 4-*a*. The bracket 66 which interconnects the rod 63 and the lever operating shaft 39 is mounted for pivotal motion around a pivot 79 on the doffing apparatus 4 and has a pair of rollers which clamp the operating shaft 39 therebetween. Accordingly, the movement of the rod 63 causes the bracket 66 to be pivoted in a direction of an arrow mark 80 around the pivot 79. As a result, the lever operating shaft 39 is moved in a direction of an arrow mark 81 until the cradle opening lever 32 is abutted against a side face of the bobbin B. Consequently, the position of the empty bobbin B is corrected to a substantially same position, as viewed in front elevation, with the fully wound package P supported on the cradle arm 77. Subsequently, the first cam plate 47 pivots the first rocking lever 52 counterclockwise as seen in FIG. 4-*b* to move the first rod 61 in a direction of an arrow mark 82 thereby to pivot the cradle opening lever 32 in a direction of an arrow mark 83 until an end thereof comes to a position between one of the cradle arms 77 and the fully wound package P. Then, again by an action of the third cam plate 49, the third rod 63 is allowed to return in a direction of an arrow mark 84 so that the cradle opening lever 32 is moved in a direction of an arrow mark 85 to move open the one cradle arm 77 as seen in FIG. 4-*c*. It is to be assumed here that the one cradle arm 77 is mounted for opening and closing pivotal motion at a base end thereof and is urged in a closing direction by means of a spring (not shown).

The fully wound package P which has been thus released from the cradle arms 77 now drops onto a pair of rods 86 which extends below and along the substantially whole length of the machine bed of the spinning machine. Then, by an action of the second cam plate 48, the second rocking plate 53 is pivoted in a direction of an arrow mark 87 as seen in FIG. 4-*d* to pivot the operating member 69 in a direction of an arrow mark 88 so that the roller 68 on the operating member 69 is pressed against a cradle portion as hereinafter described to pivot the cradle arms 77 in a direction of an arrow mark 89 until the arm 77 is abutted against a stop 90 provided on the cradle opening lever 32 to stop the pivotal motion of the cradle arms 77. Subsequently, by an action of the fourth cam plate 50, the fourth rocking lever 55 is pivoted in a direction of an arrow mark 91 as seen in FIG. 4-*e* move the fourth rod 64 in a direction of an arrow mark 92 to pivot the operating member 73 in a direction of an arrow mark 93 so that the bobbin supporting arm 31 is pivoted in a direction of an arrow mark 94 thereby to cause the empty bobbin B to be positioned in the bobbin holding portion of the cradle arm 77. Thereafter, the cradle opening lever 32 is pivoted by an action of the third cam plate 49 so that the empty bobbin B is now clamped between the cradle arms 77 whereafter the cradle opening lever 32 and the bobbin supporting arm 31 are allowed to return to their respective initial positions as shown in FIG. 3 by an action of the first and fourth cam plates 47, 50, respectively, and simultaneously the clutch 38 is disengaged to thus complete a doffing operation. In the returning step of the bobbin supporting arm 31, the bobbin B is released from the holding portion 75 of the bobbin supporting arm 31 and is thus left on the cradle arms 77, and in the returning step of the cradle opening lever 32, the cradle arm 77 is released from the stop 90 and thus pivots further in the rightward direction from the position as shown in FIG. 4-*d*. But the cradle arm 77 is arrested by another stop (not shown) to thus prevent contact of the bobbin B with a drive shaft as hereinafter described until completion of a subsequent yarn knotting step.

It is to be assumed that an empty bobbin B which is newly loaded by the doffing apparatus 4 as described above has some amount of a yarn wound thereon by a suitable means (not shown). After completion of a doffing operation, the travelling truck 8 will then move in a leftward direction as viewed in FIG. 1, and then stop again to position the knotter 6 relative to the bobbin B supported on the cradle arms 77. In this position, the yarn of the bobbin B is knotted to an upper yarn on the spinning unit by the knotter 6 in a manner as described hereinabove to thus resume spinning.

The fully wound package P which has been doffed and placed on the rods 86 is suitably collected by an operator, but an automatic conveying means such as a conveyor or the like may be employed in place of the rods 86. Further, after completion of a doffing operation as described above, the travelling truck 8 is sure to subsequently perform yarn knotting at the spinning unit U. But, if the doffing apparatus 4 and the knotter 5 are disposed in a spaced relationship by a distance which is equal to a distance between adjacent spinning units U, then while a doffing operation is being performed by the doffing apparatus 4, a yarn knotting operation at an adjacent next spinning unit can be performed simultaneously. When full winding of a package and yarn breakage have occurred at different spinning units, yarn knotting may preferably be given priority in consideration of a degree of urgent necessity and of an operational speed. But, production of a fully wound package is generally low in frequency compared with occurrence of a yarn breakage, and accordingly, normally when there is no fully wound package produced, the travelling truck 8 only acts as a knotter truck for a yarn knotting operation.

In the followings, description will be given of means responsive to full winding of a package P for disengaging the cradle arm 77 from a drive shaft 95.

Figure 5:
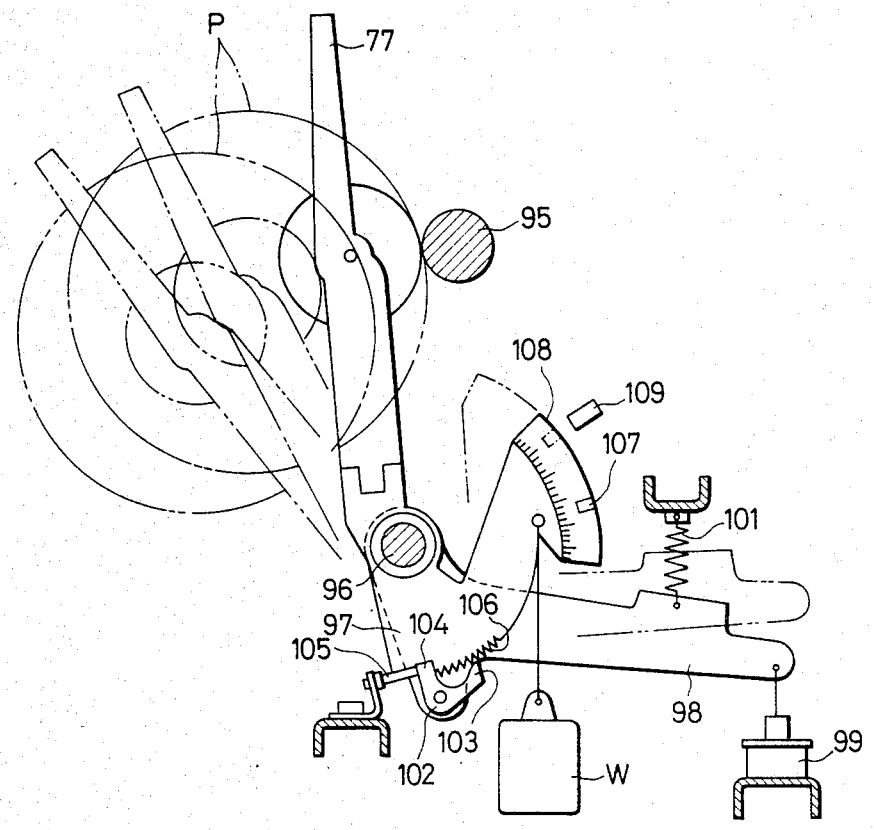
FIG. 5 is a side elevational view showing a mechanism for pivoting a cradle arm.

FIG. 5 shows details of a mechanism for pivoting the cradle arm 77. This mechanism is provided for each pair of the cradle arms 77. Each cradle arm 77 is supported for pivotal motion on a cradle shaft 96 which is provided on the machine bed of the spinning machine. The cradle arm 77 has an operating portion 97 formed at an opposite end portion thereof relative to the cradle shaft 96. The cradle shaft 96 further has an elongated cradle operating arm 98 supported for pivotal motion thereon. The cradle operating arm 98 is connected at an outer end thereof to a solenoid device 99 secured to the machine bed while it is connected at an upper end thereof to a spring 101 which is connected at the other end thereof likewise to the machine bed. The cradle operating arm 98 has a control pawl 102 pivotally mounted at a lower end thereof. The control pawl 102 has a pawl portion 103 and an engaging portion 104 formed at opposite ends thereof and is urged in a counterclockwise direction in FIG. 5 by means of a spring (not shown) to a position in which it is normally abutted at the engaging portion 104 thereof against a stop 105 secured to the machine bed. Thus, if the engaging portion 104 of the control pawl 102 is released from the stop 105, then the control pawl 102 is pivoted counterclockwise until the pawl portion 103 is engaged with a toothed gear portion 106 formed on the operating portion 97 of the cradle arm 77. Further, a weight W is suspended on the operating portion 97 to urge the entire cradle arm 77 to pivot in a clockwise direction in FIG. 5. In addition, the cradle arm operating portion 97 has provided on an arcuate portion thereof a scale 108 to which a metal mark 107 can be movably adhered while a sensor 109 for detecting the mark 107 is secured to the machine bed.

Now, operations of the cradle arm pivoting mechanism will be described. As winding of a yarn proceeds, the diameter of a package P becomes larger and the cradle arm 77 is gradually inclined leftwardly in FIG. 5 against the gravity of the weight W. The mark 107 is adjusted on the scale 108 depending upon to what degree full winding of a package P is set. During such gradual inclination of the cradle arm 77, the sensor detects existence of the mark 107 when the package P becomes full as shown by a dot and dash line in FIG. 5. In response to such detection by the sensor 109, the solenoid device 99 is deenergized, and the yarn is cut by means of a device not shown. Then, the cradle operating arm 98 is pivoted upwardly by a force of the spring 101 and thereupon, the engaging portion 104 of the control pawl 102 is released from the stop 105 so that the control pawl 102 is pivoted to engage the pawl portion 104 thereof with the toothed gear portion 106 of the operating portion 97 of the cradle arm 77. As a result, the cradle arm 77 is further inclined leftwardly to disengage the package P from the drive shaft 95 as shown by a two dots and dash line to a position for preparation for a subsequent next doffing operation as described hereinabove. Then, after the thus fully wound package P has been removed from the cradle arm 77 in a manner as described hereinabove with reference to FIGS. 4-*a* through 4-*e*, the roller 68, which has been mentioned with reference to FIG. 4-*d*, pushes down an end of the cradle operating arm 98 to remove the pawl portion 103 of the control pawl 102 again from the gear portion 106 of the cradle arm 77 thereby to bring the cradle arm 77 to a position in which it is urged in the clockwise direction in FIG. 5 by the weight W. After completion of a doffing operation, the solenoid 99 is energized again and the cradle operating arm 98 is returned to its initial position as shown by a full line in FIG. 5.

Now, description will be given of a mechanism for supplying a bobbin B to the doffing apparatus 4.

Figure 6:
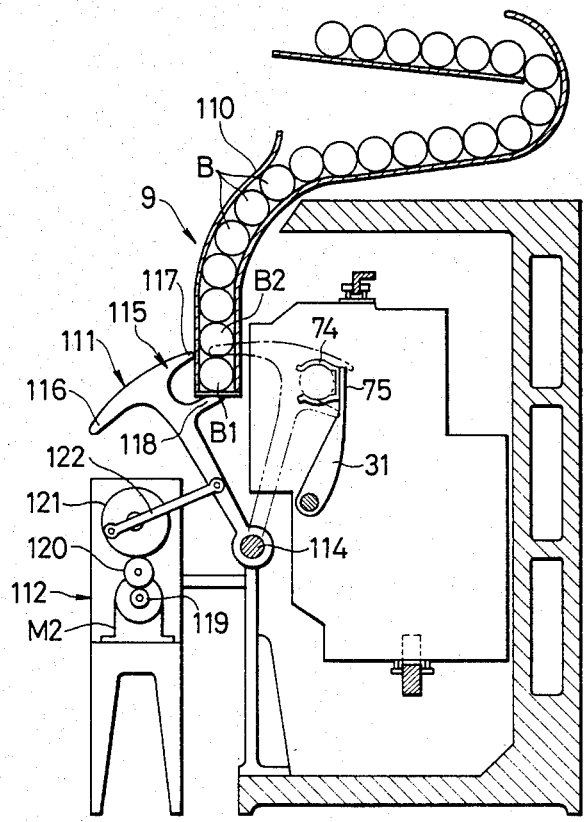
FIG. 6 is a vertical sectional schematic side elevational view across the spinning machine together with a bobbin supply device and the doffing truck.
Figure 7:
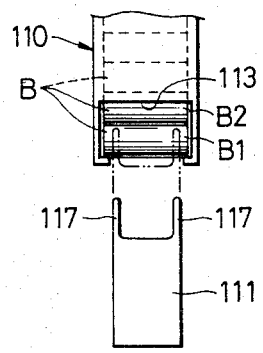
FIG. 7 is a diagrammatic representation showing part of a bobbin guide and a bobbin feeding arm.

Referring to FIG. 6 which shows a vertical sectional schematic side elevational view across the doffing truck 5 and the bobbin supply device 9 of the spinning machine, the bobbin supply device 9 includes a bobbin guide 110 located above the machine bed for successively introducing one after another of bobbins B, a bobbin feeding arm 111 pivotally supported on the machine bed for feeding a bobbin B from the bobbin guide 110 to the doffing apparatus 4, and a driving device 112 for pivotally driving the feeding arm 111. The bobbin guide 110 has formed at a lower end thereof an opening 113 which is sufficiently large to allow a single bobbin B to pass therethrough as seen in FIG. 7; a lowermost bobbin B1 is arrested only at opposite ends of a lower surface thereof and is held from dropping. Meanwhile, the bobbin feeding arm 111 is supported on a pivot 114, and has a bobbin supporting portion 115 of a substantially C-shape in side elevation, and an elongated outwardly extending bobbin controlling portion 116. The bobbin supporting portion 115 has two pairs of upper jaws 117 and lower jaws 118. Upon pivotal motion of the bobbin feeding arm 111, the jaws 117, 118 enter the opening 113 of the bobbin guide 110 as seen in FIG. 7 to clamp and support a lowermost bobbin B1 thereamong and then move to opposite sides of the holding portion 75 of the doffing apparatus 4 as shown by a dot and dash line in FIG. 6 to fit the lowermost bobbin B1 into the holding portion 75 of the doffing apparatus 4. During such a pivotal motion of the bobbin feeding arm 111, the upper jaws 117 enters between the lowermost bobbin B1 and another bobbin B2 just above whereafter the second lowermost bobbin B2 is held from dropping at an upper end of the bobbin feeding arm 111 including the bobbin controlling portion 116 until the bobbin feeding arm 111 is returned to its initial position. The second lowermost paper tube B2 is thereafter released from the upper jaws 117 to drop to a lowermost position at a point of time when the feeding arm 111 is returned to its initial position. The driving device 112 reduces the speed of rotation of a motor M2 by means of gears 119, 120 and 121 thereof and rocks the bobbin feeding arm 111 by way of a crank 122 having one end connected to the gear 121. Here, if a position of the bobbin feeding arm 111 as shown by a full line of FIG. 6 is referred to as a stand-by position, then a pivotal motion of the bobbin feeding arm 111 from the stand-by position to an operative position as shown by a dot and dash line in FIG. 6 is initiated in response to detection by a sensor (not shown) that there is no bobbin B present in the holding portion 75 of the bobbin supporting arm 31 when the doffing truck 5 stops in front of the bobbin supply device 9. It is to be noted tht the bobbin feeding arm 111 may be pivotally driven by any other suitable means such as a cylinder in place of the driving device 112.

An outline of operations of the spinning machine described above will be described again in the followings. The doffing truck 5 and the yarn knotting truck 7 are joined together to form the single travelling truck 8, and when no package P on the winding side is wound full, the travelling truck 8 acts as an ordinary knotter truck and thus performs a yarn knotting operation by the knotter 6 while travelling along the row of the spinning units U. Meanwhile, if a package P has become full and there is no yarn breakage occurring at any other spinning unit, then the travelling truck 8 immediately travels to a position in front of the fully wound package P and positions the doffing apparatus 4 relative to the package P to stop thereat. Then, the fully wound package P is transferred from the cradle arms 77 onto the two rods 86 and a new bobbin B supported on the bobbin supporting arm 31 is fed to the cradle arm 77 in order to effect doffing thereof. After completion of doffing, the travelling truck 8 travels a little to position the knotter 6 relative to the new bobbin B, and then a yarn wound on the new bobbin B is knotted to another yarn on the spinning side by a known means to resume spinning. The travelling truck 8 which has thus completed doffing and yarn knotting now travels to the bobbin supply device 9 on one side of the machine bed at which it is supplied with a next new bobbin B by the bobbin feeding arm 111. Thus, the travelling truck 8 waits for production of a subsequent new fully wound package or for occurrence of a breakage of a yarn.

For doffing and yarn knotting operations as described above, the doffing truck 5 travels in integral relationship with the yarn knotting truck 7 within the truck travelling space. Since the doffing truck 5 is provided on one side of the yarn knotting truck 7 in the travelling direction of the truck 7 and travels along the same path within the travelling spacing of the yarn knotting truck 7, additional installation of the doffing apparatus 4 would require no additional space therefor in the spinning machine. Besides, since there is no necessity for individually controlling movements of the doffing truck 5 and the yarn knotting truck 7, a control device will not become complicated and both trucks 5 and 7 do not interfere with each other.

While the embodiment is constituted such that bobbins B are supplied one after another from the bobbin supply device 9 each time doffing is effected as described above, it is confirmed that doffing and yarn knotting can be effected satisfactorily on a spinning machine which, for example, includes up to 60 spindles that spin at a speed 130 to 150 m/min and wherein it takes 15 to 20 hours for a spinning unit to become full with a yarn, if the frequency of occurrences of a yarn breakage is 10 to 40 times/60 sp.Hr, the travelling speed of the travelling truck is 60 sec/60 sp, a time required for a doffing operations is 15 seconds, and a time required for a yarn knotting operation is 15 seconds.

As described hereinabove, according to the present invention, there is no necessity to provide additional space for installation of a doffing apparatus, and already existing equipments can be utilized effectively to realize a functional spinning machine with a doffing apparatus.

What is claimed is:

1. A spinning machine of the type wherein a yarn knotting truck having a knotter provided thereon is adapted to travel in a truck travelling space provided along a number of spinning units included in said spinning machine, the travelling of said knotting truck being controlled in a known manner in order to successively effect knotting at said individual spinning units, further comprising:

a doffing truck;

a doffing apparatus, carried on said doffing truck, said doffing apparatus being operably adapted for effecting doffing of packages of said spinning units which have a fully wound yarn package thereon; and means, associated with each spinning unit, for sensing the presence of a fully wound yarn package, for identifying the spinning unit containing said fully wound yarn package, and for communicating a doffing request signal to said doffing truck;

said truck travelling space being formed internal of each spinning unit such that a knotting operation and a doffing operation may be directly observable;

said doffing truck being caused to operate, in response to the doffing request signal, so that it travels in said truck travelling space until aligned, by known means, with the spinning unit communicating the doffing request signal whereat said doffing of the package is effected.

2. A spinning machine as claimed in claim 1, wherein said yarn knotting truck, having a knotter of a known type provided thereon and said doffing truck, having said doffing apparatus provided thereon, are formed as a combined single truck which travels in the truck travelling space so as to be capable of appropriately aligning both the knotter and the doffing apparatus, as may be selectively required, with each of the spinning units of the spinning machine.

3. A spinning machine as claimed in claim 2, wherein each of the number of spinning units are mounted on a frame member of said spinning machine, said frame member comprising:

an upper horizontal portion, generally supporting a a spinning section of each spinning unit;

a lower horizontal portion, generally supporting a winding section of each spinning unit; and an interconnecting vertical portion, supporting said upper horizontal portion in a spaced apart relationship from said horizontal portion;

said upper horizontal portion, said lower horizontal portion and said interconnecting vertical portion being mutually disposed so as to generally define thereamong the truck travelling space within which the combined single truck travels;

said truck travelling through said travelling space along a pair of rails, one depending from said upper horizontal portion and the other supported by said lower horizontal portion, both rails extending along the extent of the number of spinning units.

4. A spinning machine as claimed in claim 3, further comprising:

means, comprising a further part of said doffing apparatus, for holding a bobbin and for transferring the held bobbin to the winding section of the spinning unit from which a fully wound package has been doffed;

means for indicating the presence or absence of the held bobbin in the doffing apparatus;

a bobbin supply device, disposed at one end of the number of spinning units, the bobbin supply device including extensions of the rails and the truck travelling space so as to be accessible by the doffing truck portion of the combined single truck, said bobbin supply device including means for transferring a bobbin from said bobbin supply device to the means of the doffing apparatus for holding a bobbin;

wherein, in response to the indication of an absence of a held bobbin in said doffing apparatus, said doffing truck is positioned to said bobbin supply device whereat the means for transferring a bobbin from said bobbin supply device and the means for holding the bobbin in the doffing apparatus are cooperatively operated to effect the transfer of a bobbin from the bobbin supply device to the doffing apparatus.

5. A spinning machine as claimed in any of claims 2 to 4, wherein the means for holding a bobbin and for transferring the held bobbin to the winding section of the spinning unit, said means forming a part of the doffing apparatus, comprises:

a bobbin supporting arm, adapted for holding a bobbin thereon, and pivotally mounted on said doffing truck for feeding the bobbin to the winding section of the spinning unit;

a cradle opening lever, pivotally mounted on said doffing truck and operable to open a bobbin holding cradle of the winding section during supply of a bobbin to the winding section; and a driving mechanism, mounted on said doffing truck and operable to first pivot the cradle opening lever into engagement with the cradle in order to open the cradle, to then pivot the bobbin supporting arm so as to place the bobbin at the cradle, to then pivotally retract the cradle opening lever to allow the cradle to engage the bobbin, and to then pivotally retract the bobbin supporting arm.

6. A spinning machine as claimed in claim 5, wherein the driving mechanism comprises:

a main shaft, rotatably mounted on the doffing truck, the axis of rotation of said main shaft being generally aligned to be parallel with the rails;

a cam shaft, rotatably mounted on the doffing truck with its axis of rotation in parallel with that of said main shaft;

a first gear secured on said cam shaft;

four cam plates secured on said cam shaft;

a cradle operating shaft, rotatably mounted on the doffing truck with its axis of rotation in parallel with that of said main shaft;

a cradle operating member, coupled to said cradle operating shaft such that rotation of said cradle operating shaft brings said cradle operating member into contact with the cradle of the winding section so as to cause the cradle to pivot, thereby disengaging the package from its driving mechanism;

a bobbin supporting arm operating shaft, rotatably mounted on the doffing truck with its axis of rotation parallel with that of said main shaft, the rotation of said bobbin supporting arm operating shaft being pivotably communicated to said bobbin supporting arm;

a cradle opening lever operating shaft, mounted on said doffing truck so as to be capable of rotational motion about, and sliding motion along, a rotational axis in parallel with that of said main shaft, said cradle opening lever being rigidly coupled to, and said bobbin supporting arm being rotatably mounted on, the cradle opening lever operating shaft;

a motor, mounted on said doffing truck, said motor, when energized, producing rotational motion of an output shaft having an axis of rotation in parallel with that of said main shaft;

a driven sprocket rotatably mounted on a shaft affixed to said doffing truck, said shaft being disposed in parallel with said main shaft;

means for communicating the rotational motion of the output shaft of the motor to the driven sprocket;

a second gear, mounted on the shaft of the driven sprocket so as to rotate thereabout independently of said driven sprocket, said second gear being so disposed as to be in operable engagement with said first gear; and a ball clutch disposed on the shaft of the driven sprocket, said clutch being operable, when engaged, to couple the rotation of the driven sprocket to the second gear, thereby causing the second gear to rotate with said driven sprocket;

said mechanism being so constructed, and the several component elements being so adapted to cooperate, when said ball clutch is engaged, to cause the rotation of the output shaft of the motor to be communicated, through the means communicating said motion to the drive sprocket, the second gear and the first gear, to produce a single full revolution of the cam shaft, which in turn sequentially results in sliding the cradle opening lever operating shaft along its axis, by action of the rotation of the cam plates, thereby abutting the cradle opening lever against a side face of the bobbin held in the bobbin supporting arm so as to correct the position of the bobbin to a substantially same alignment position, along the extent of the spinning machine, with a fully wound package supported on the cradle arms of the winding section, then producing further rotation of said cams, causing the cradle opening lever operating shaft to slide in a reversed direction to its original position, then producing further rotation of the cams to cause rotation of the cradle opening lever operating shaft, thereby pivoting the cradle opening lever until a distal end of the cradle opening lever comes to a position between one of the cradle arms of the winding section and the fully wound package held by the cradle, thereby enabling the fully wound package which has been released from the cradle arm to fall from the winding section, then producing further rotation of the cams to cause rotation of the bobbin supporting arm operating shaft, thereby pivoting the bobbin supporting arm about the cradle opening lever operating shaft to a position of a bobbin holding portion of the cradle arm, then producing further rotation of the cams to cause reverse rotation of the cradle opening lever operating shaft, thereby pivoting the cradle opening lever to a withdrawn position, thus releasing the cradle arms to clamp the bobbin held by the bobbin supporting arm, and then producing further rotation of the cams to cause reversed rotation of the bobbin supporting arm operating shaft which causes the bobbin supporting arm to pivot about the cradle operating lever operating shaft to its withdrawn position.

7. A spinning machine as claimed in claim 3, in which the winding section of each spinning unit includes:

a pair of cradle arms for supporting a package substantially at the center of the extent of each arm, which arms are supported proximate to one end thereof respectively, for parallel pivotal motion on a cradle shaft affixed to the winding section; and a drive shaft for rotationally driving the package held between the cradle arms;

wherein said spinning machine further comprises:

a mechanism, included within each of the winding sections, for pivoting the cradle arms for disengaging the package from the drive shaft when the package is fully wound; said mechanism comprising:

an operating portion integrally formed as an extension of the cradle arm extending, relative to the cradle shaft, in a direction generally opposite that of the package supporting extent, said operating portion having a toothed gear portion at a distal end thereof;

a cradle operating arm supported near one end thereof on the cradle shaft for pivotal motion therearound;

a solenoid, mounted on a frame of said winding section, having its movable shaft connected to a distal end of the cradle operating arm, such that operation of the solenoid causes the cradle operating arm to pivot about the cradle shaft;

a spring extending in tension between the distal end of the cradle operating arm and the machine bed so as to urge the cradle operating arm to pivot about the cradle shaft in a direction away from the solenoid;

a control pawl pivotally mounted at a lower end of an extension of the cradle operating arm proximate to, and being able to engage with, the toothed gear portion of the operating portion extension of the cradle arm;

a stop secured to the machine bed disposed so as to abut against the control pawl; and a weight suspended from an angularly formed extension of the operating portion in a position so as to urge the cradle arm to pivot in a direction tending to move the package toward the drive shaft;

whereby, as the diameter of the package increases during a winding operation, the cradle arms pivot about the cradle shaft in a direction moving the package support position away from the drive shaft against the influence of the weight tending to pivot the cradle arms to maintain the package in contact with the drive shaft, throughout which winding operation the toothed gear portion of the operating portion passes freely past the control pawl, which is held from engagement with the toothed gear portion by the stop;

such operating continuing until a fully wound package is sensed by appropriate means, whence the solenoid is deenergized, enabling the cradle operating arm to pivot about the cradle shaft under the urging of the spring, thereby disengaging the pawl from the stop and enabling the pawl to engage the toothed gear portion of the operating portion of the cradle arm, which causes the cradle arm to be coupled in motion to the cradle operating arm so that the further urging of the spring in pivoting the cradle operating arm will pivot the cradle arms about the cradle shaft to disengage the package from the drive shaft.

8. A spinning machine as claimed in claim 4, wherein the bobbin supply device comprises:

a bobbin guide for successively introducing a substantially continuous sequence of bobbins rolling into a substantial vertical stack within said guide, said guide having an opening formed at a lower end thereof which is sufficiently large to allow a single bobbin to pass therethrough in a direction transverse to the vertical extent of the guide and transverse to the extent of the spinning machine, said bobbins being so oriented within said guide as to have their respective axes substantially parallel with the rails of the spinning machine;

a bobbin feeding arm pivotally supported on a shaft affixed to the machine bed, said shaft being aligned to be substantially parallel with the rails of the spinning machine, said bobbin feeding arm having two pairs of upper jaws and lower jaws, adapted to hold a bobbin during pivoting of the bobbin feeding arm, the bobbin feeding arm being further adapted to hold all other bobbins in the sequence within the bobbin guide from progressing to the opening during a pivoting operation of the bobbin feeding arm; and a driving device for intermittently pivotally driving the bobbin feeding arm, in response to a control command, such that said jaws enter the opening of the bobbin guide to clamp the bobbin situated thereat and carry it, by further pivoting of the bobbin feeding arm, to the doffing apparatus whereat said bobbin is retained by said bobbin supporting arm, the driving device subsequently pivotally returning the bobbin feeding arm to its initial pivotal position whereat the sequence of bobbins falls within the bobbin guide to place the next bobbin adjacent said opening in the bobbin guide.

9. A spinning machine as claimed in claim 7, wherein said mechanism for pivoting the cradle arm for disengaging the package from the drive shaft further comprises:

an arcuate extension integrally formed on the operating portion of the cradle arm, said arcuate extension having a sensable scale formed thereon to be an arc concentric with said cradle shaft, said scale providing at least one variably preset indicator at a position along said arc established to correspond to a fully wound package; and a sensor, affixed to the frame of the winding section disposed in a position for detecting said scale, said sensor producing a fully wound package output signal when the fully wound package indicator of the scale is brought, by pivoting of the cradle arm as the package diameter increases during winding, to the sensing position of the sensor.

* * * * *